US007633730B2

(12) United States Patent
Boeder et al.

(10) Patent No.: US 7,633,730 B2
(45) Date of Patent: Dec. 15, 2009

(54) CIRCUIT BREAKER AND SHORT CIRCUITER COMBINATION

(75) Inventors: Franz Boeder, Ahrbrueck (DE); Andreas Schumacher, Dattenberg (DE); Volker Friedrich, Roth (DE)

(73) Assignee: Moeller GmbH, Bonn (DE)

( * ) Notice: Subject to any disclaimer, the term of this patent is extended or adjusted under 35 U.S.C. 154(b) by 123 days.

(21) Appl. No.: 11/773,575

(22) Filed: Jul. 5, 2007

(65) Prior Publication Data

US 2008/0007881 A1 Jan. 10, 2008

(30) Foreign Application Priority Data

Jul. 4, 2006 (DE) ..... 10 2006 030 671

(51) Int. Cl.
*H01H 73/00* (2006.01)

(52) U.S. Cl. ..... 361/54; 361/115

(58) Field of Classification Search ..... 361/42, 361/44, 115

See application file for complete search history.

(56) References Cited

U.S. PATENT DOCUMENTS

| | | | | |
|---|---|---|---|---|
| 2,924,752 | A * | 2/1960 | Scott, Jr. | 361/12 |
| 4,949,214 | A * | 8/1990 | Spencer | 361/95 |
| 5,168,137 | A * | 12/1992 | Hufnagel et al. | 200/50.02 |
| 7,145,757 | B2 * | 12/2006 | Shea et al. | 361/2 |
| 2008/0006607 | A1 | 1/2008 | Boeder et al. | |

FOREIGN PATENT DOCUMENTS

| | | |
|---|---|---|
| DE | 6906985 | 1/1970 |
| DE | 4110335 | 10/1992 |
| DE | 4404074 | 8/1995 |
| DE | 4438593 | 5/1996 |
| DE | 19712387 | 10/1997 |
| DE | 19643607 | 11/1997 |
| DE | 10113698 | 10/2001 |
| DE | 10254497 | 6/2004 |
| DE | 10313045 | 7/2004 |
| DE | 69930494 | 11/2006 |
| EP | 0414657 | 2/1991 |
| EP | 0575932 | 12/1993 |
| EP | 1052665 | 11/2000 |
| WO | WO-0002320 | 1/2000 |
| WO | 0062320 | 10/2000 |

OTHER PUBLICATIONS

European Search Report for EP 1 876 626, dated Apr. 28, 2008.

* cited by examiner

*Primary Examiner*—Danny Nguyen
(74) *Attorney, Agent, or Firm*—Darby & Darby

(57) ABSTRACT

A circuit breaker for multi-phase power includes an opening-closing apparatus configured to open and close each phase of the multiphase power, a detection unit configured to detect a fault current in at least one phase of an electrical installation being protected by the circuit breaker, a plurality of connecting bars disposed on a load side of the circuit breaker, and a short circuiter disposed on the connecting bars and configured to produce a short circuit between the connecting bars if a fault current is detected by the fault-current detection unit. When a fault current occurs, a tripping signal can be transmitted by the detection system to the short circuiter. The circuit breaker is also fully operational, even without a function-activated short circuiter.

13 Claims, 3 Drawing Sheets

CIRCUIT BREAKER AND SHORT CIRCUITER COMBINATION

Priority is claimed to German Patent Application No. 10 2006 030 671.6, filed on Jul. 4, 2006, the entire disclosure of which is incorporated by reference herein.

The present invention relates to an electric circuit breaker, especially to a power breaker for low voltage.

BACKGROUND

When a fault current occurs, especially an overcurrent, or when a short-circuit or an arcing fault occurs, the current-breaking capacity and turn-off time of a power breaker are dependent on various parameters. The turn-off process is made up of the tripping time, the inherent delay and the turn-off time. The tripping time is the time from the occurrence of the variable that causes the tripping until the initiation of the tripping process, for instance, the release of a breaker latch. This is followed by the inherent delay of the circuit breaker, which is determined by the dynamic processes of the contacts of the circuit breaker as they move and open. A turn-off time of about 50 msec is expected in a circuit breaker for the higher power range (rated current up to 100 kA).

Severe injury to persons and/or material damage can result from the occurrence of an arcing fault in an electrical installation, so this should be prevented to the greatest extent possible. In order to limit such injury or damage, several measures have been proposed, of which the optimal solution is to interrupt (to extinguish) the arcing fault in a shorter time than the turn-off time of the incoming circuit breaker.

It is a known procedure to use short circuiters to interrupt arcing faults in electrical installations. Various systems that detect physical effects of the burning arc (light, sound, pressure) can be used in such an arrangement for extinguishing an arcing fault. A proven system is based on the optical detection of an arc (EP 0575 932 B1). In order to switch off the arc, various short circuiter arrangements are proposed, for example, the use of a pyrotechnically driven short circuiter (EP 1052 665 B1 or WO 200062320 A1), by means of a short-circuit to be produced by thyristors (DE 4438593 A1) or by using a vacuum interrupter (DE 4404074 A1). Such short circuiters produce a short-circuit between the phases of the electric power system, between which the arc burns, so that the arcing fault can be extinguished within a period of time shorter than 3 msec. The advantage of an arc detection and extinguishing system is obvious.

After the short circuiter has been tripped, a short-circuit current is still flowing that is interrupt by the serially connected incoming circuit breaker (after its turn-off time), as a result of which the defective electrical installation is ultimately disconnected from the electric power system. Accordingly, a system that detects and extinguishes arcing faults consists of detection means, a short circuiter and the appertaining electronic switching means.

When a "conventional" arc detection and extinguishing system is installed, a short circuiter is connected in parallel to the power breaker in such a way that additional conductor bar elements are arranged on the conductor bar connections of the power breaker, whereby the short circuiter is positioned on the ends of said elements. The attributes, particularly the cross section of the conductor bar elements, have to match those of the conductor bars with which the power breaker and the electrical installation are supplied. This means that for the—actually "passive"—short circuiter, which is only provided for the rare serious case of an arcing fault, there is a need for a considerable amount of material. For this reason, the length of the conductor bars to be used for the connection of the short circuiter has to be selected as short as possible so that the short circuiter lies at a relatively close distance from the power breaker.

The conductor bars through which load current flows and the power breaker are heated up by the current heat and acquire an elevated operating temperature. This elevated operating temperature also spreads to the short circuiter via the highly conductive connecting bars. However, short circuiters, especially those configured as pyrotechnical short circuiters, have a thermal load limit. For instance, up until now, a pyrotechnical generator must not be operated at a continuous temperature above 85° C. [185° F.]. In order to rule out a thermal load, cooling elements are clipped onto the connecting bars when the pyrotechnical short circuiters are installed. The use of cooling elements likewise constitutes an additional material requirement.

SUMMARY OF THE INVENTION

An object of the present invention is to provide measures for a circuit breaker that account for a reduction in the material requirement and that allow a short-circuit to be interrupted more quickly than the normal function of the circuit breaker.

An aspect of the invention is that, at least on the load side of the circuit breaker, a short circuiter is arranged on the connecting bars in order to produce a short-circuit between the connecting bars, for cases when a fault current is detected by a fault-current detection unit. A short-circuit or a burning arcing fault can be detected and interrupted as fault current. A short circuiter can also be configured on the electric power system side of the circuit breaker.

For purposes of installing the short circuiter, fastening means that permit simple, fast and detachable fastening should be on hand. For example, a tension-lever system can be employed with which—without screwed connections—the short circuiter can be securely clamped onto the connecting bars. As an alternative, it can also be provided that the connecting bars of the circuit breaker have threaded bolts that correspond with connecting points in the short circuiter where, for instance, bores are provided which can be slid over the threaded bolts. The fastening is then effectuated using screws (optionally with washers).

It is evident that it is advantageous, along with the presence of the short circuiter, to likewise install an arc-detection system in the electrical installation. In a "simplified" version, however, the detection of a fault current can be limited exclusively to the use of a short-circuit detector (current transformer and short-circuit actuator) in the circuit breaker. It should be clear to the person skilled in the art that this configuration can only be the lowest stage of a safety system against installation malfunctions.

The typical use of a short circuiter involves the arrangement on the load side of the circuit breaker. In this manner, the short circuiter is situated between the circuit breaker and the actual electrical installation (for instance, a switching or distribution station, a transformer station, an electrical motor) and it disconnects the installation from the electrical power system in case of the occurrence of a short circuit.

However, a short circuiter can also be installed on the electric power system side of the short circuiter. Thus, in the case of an "extensive protection situation", two short circuiters can also be present: one before and one after the circuit breaker. The use of the circuit breaker on the electric power system side entails the advantage that the entire connection area (transformer, cables, bars) is situated "before the circuit breaker" in the monitoring zone of the short circuiter. If an arcing fault occurs in the connection area, an activated short circuiter extinguishes the arcing fault and the upstream, superordinated incoming circuit breaker then has the "task" of interrupting the short-circuit that is present. In order to optimize the system, it can also be provided that an arcing-fault detector is installed in the connection area by means of which a switching signal can be sent to the short circuiter.

The arrangement according to the invention allows the circuit breaker to be fully operational, irrespective of whether the short circuiter is functional (set) or has been taken out of operation (but is not short-circuited).

Fastening means and/or an insertion shaft can be provided for the short circuiter. The short circuiter should be accessible from the outside at all times. For safety reasons, once a short circuiter has been installed, it should be configured so that it can be locked. Preferably, there should be a cover or a lid.

It is likewise proposed that means be provided for placing a lead seal on an installed short circuiter. The short circuiter can then only be changed by destroying the lead seal. In this manner, the short circuiter can be secured against unauthorized removal.

Additional advantageous embodiments of the invention will be presented below.

Electrical contact means are present that are suitable to accommodate electrical counter-contact means arranged on the short circuiter. It is via the contact means that the short circuiter is controlled by the circuit breaker or by an electronic module present in the circuit breaker. The electrical contact means (for instance, plugs and sockets) are automatically coupled when the short circuiter is slid into the insertion shaft.

Electrical output data, operating parameters, settings and/or tripping signals can be transmitted between the circuit breaker and the short circuiter via the contact means.

The circuit breaker can have a blocking device that prevents the circuit breaker from being switched on again, said blocking device becoming operational after the switching function has been actuated in the short circuiter.

As mentioned in the introduction, several types of short circuiter are known. The person skilled in the art will be able to determine and select a short circuiter that is well-suited for the envisaged purpose. Preferably, a pyrotechnically driven short circuiter is recommended. A chemical mechanism on the basis of nitrocellulose can be provided to drive it. The connecting bars in the short circuiter form a sandwich-like packet. The pyrotechnical drive propels a metal bolt through the stack of connecting bars so that the phases are mechanically contacted with each other in less than 1 msec and a short-circuit is produced. In a situation where the short-circuit is present in the form of a burning arcing fault, energy is removed from the arc, thus extinguishing it.

The short circuiter should short-circuit at least two phases of the power connection. Technical experts are also considering the approach of configuring the short circuiter to be grounded so as to contact at least one phase of the power connection (configured to switch to one-phase grounding). Both embodiments can be employed.

As is normally done, the circuit breaker is equipped with an electronic detector to detect a fault current on the load side in at least one phase. For this purpose, a current transformer can be present that is designed to detect a fault current on the load side in one of the phases. When a pre-specified threshold for the rate of current rise and/or for the current intensity has been exceeded, an appropriate signal is transmitted via the contact means in order to activate the short circuiter.

The operating state of the short circuiter is maintained by an energy storage unit (for example, by a capacitor battery) whose stored energy is sufficient to actuate (ignite) the short circuiter drive. The charge of the energy storage unit should be permanently present. Consequently, it is advantageous if a permanent power supply is available for the energy storage unit. This should be independent of the electric power system to which the electrical installation and the circuit breaker are connected. The power supply can be configured so as to be battery-powered or else as a supply source from a parallel electrical power system. In the case of the battery-powered variant, it must be ensured that the battery is always in its fully charged state, which can be best achieved by automatically monitoring the charge.

As long as the short-circuit is still present in the short circuiter, it should not be possible to switch the circuit breaker back on. Switching the circuit breaker back on should only be possible once the short-circuit has been eliminated, which can be done by exchanging the short circuiter with a properly functioning short circuiter or by replacing the non-functioning parts or else by not replacing the short circuiter. This achieves a high level of protection for persons and equipment.

Even if no blocking device exists to prevent the circuit breaker from being switched back on, an advantage exists because the short-circuit of the short circuiter is present when the circuit breaker is switched on, but the electrical installation still remains voltage-free.

The circuit breaker according to the invention can be used in practically all conventional switchgear cabinets of electrical installations. The circuit breaker and short circuiter combination is a compact unit. It does not require additional space. For these reasons, the circuit breaker according to the invention can replace existing switching systems within the scope of a retrofitting procedure.

The conductors and the conductor bars of the circuit breaker and short circuiters should be dimensioned for a short-circuit current of more than 100 kA over a time span of up to 500 ms. With this stipulation, in the case of certain design configurations of the electrical installation, the criteria demanded for the installation in terms of its ability to withstand short-circuits can be lowered. Up until now, it has been assumed that conductor bars, bar supports and other current-carrying parts had to be dimensioned for the maximum anticipated short-circuit current. When the circuit breaker and short circuiter combination is used, the short circuiter switches off the electrical installation within 2 msec. The short-circuit load on the installation is thus minimized. Therefore, it is no longer necessary to fulfill the requirement for a maximum ability to withstand short-circuits that would otherwise exist for an electrical installation. This naturally translates into financial advantages for the installation operator.

Another advantage to be emphasized is that the switching function of the circuit breaker is shortened. The full short-circuit current that occurs directly in the circuit breaker is detected by the short-circuit actuator. Magnetic short-circuit actuators obtain the triggering energy from the fault source itself and "respond" in accordance with the magnitude of the current. In contrast to a metal short-circuit, an arcing fault constitutes an attenuated short-circuit since the arcing fault voltage drops via an infinite ohmic resistor.

As already elaborated upon, circuit breakers have a turn-off time of up to 50 msec. Circuit breakers are configured in such a way that they can be loaded with the full short-circuit current during this time span. The stronger short-circuit current that is present leads to an accelerated response by the short circuiter and thus to a shortening of the turn-off time of the circuit breaker. In a manner of speaking, a drop occurs in the voltage level for a short-circuit. The load duration is shortened. The circuit breaker is relieved, even in the case of maximum switched loads.

BRIEF DESCRIPTION OF THE DRAWINGS

Additional details and advantages of the invention ensue from the embodiments explained below with reference to the figures. The following is shown.

DETAILED DESCRIPTION

Figure 1A:
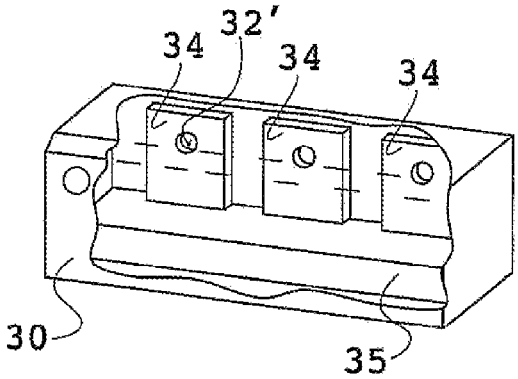
FIGS. 1A and 1B—a perspective view of the circuit breaker and short circuiter.

The depictions in the figures show a circuit breaker configured as a power breaker 10 that is installed in a three-phase (L1, L2, L3) electrical power system upstream from an electrical consumer 40. The circuit breaker has at least one detection unit (short-circuit actuator) and one overload release. The latter can be configured as a bimetal release. Overload releases operate with a time delay when a high, pre-adjustable current intensity occurs and cause the contacts of the circuit breaker to open via the breaker latch 16. The provided detection unit 20 is present in the form of an electronic unit that is actuated by the current-detection means 21. Current transformers, for instance, Hall sensors, can be provided as the current-detection means.

The circuit breaker and short circuiter combination is such that a short circuiter is present at least one fastening site.

Figure 1B:
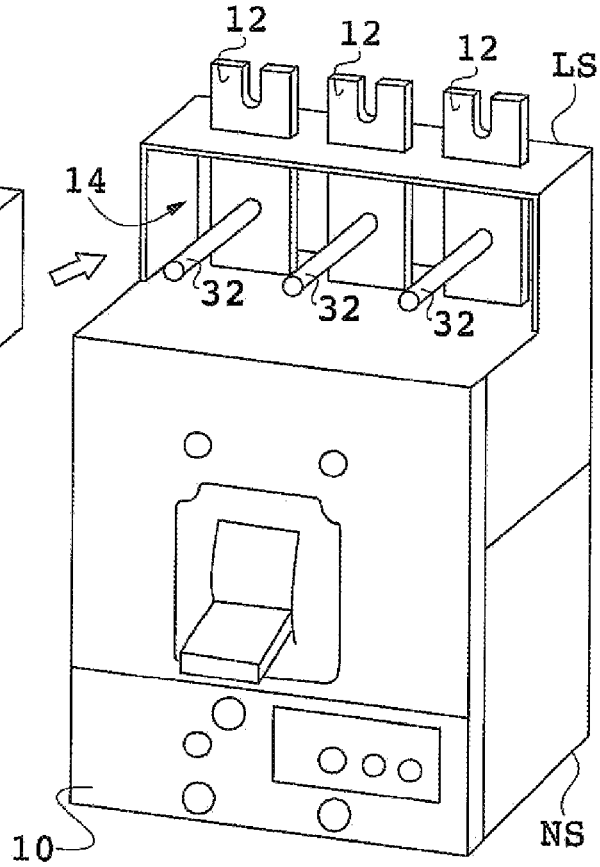

According to FIG. 1B, the load side LS of the circuit breaker has space available where a short circuiter is installed. This is where the conductor bars 12 of each phase L1, L2, L3 are accessible and provided with means 32 (here threaded bolts) so that the short circuiter 30 can be detachably installed (contacting, fastening, joining, screwing). The short circuiter 30 can be used to short-circuit the conductor bars (phases L1, L2, L3) among each other on the electrical power system side.

Figure 2:
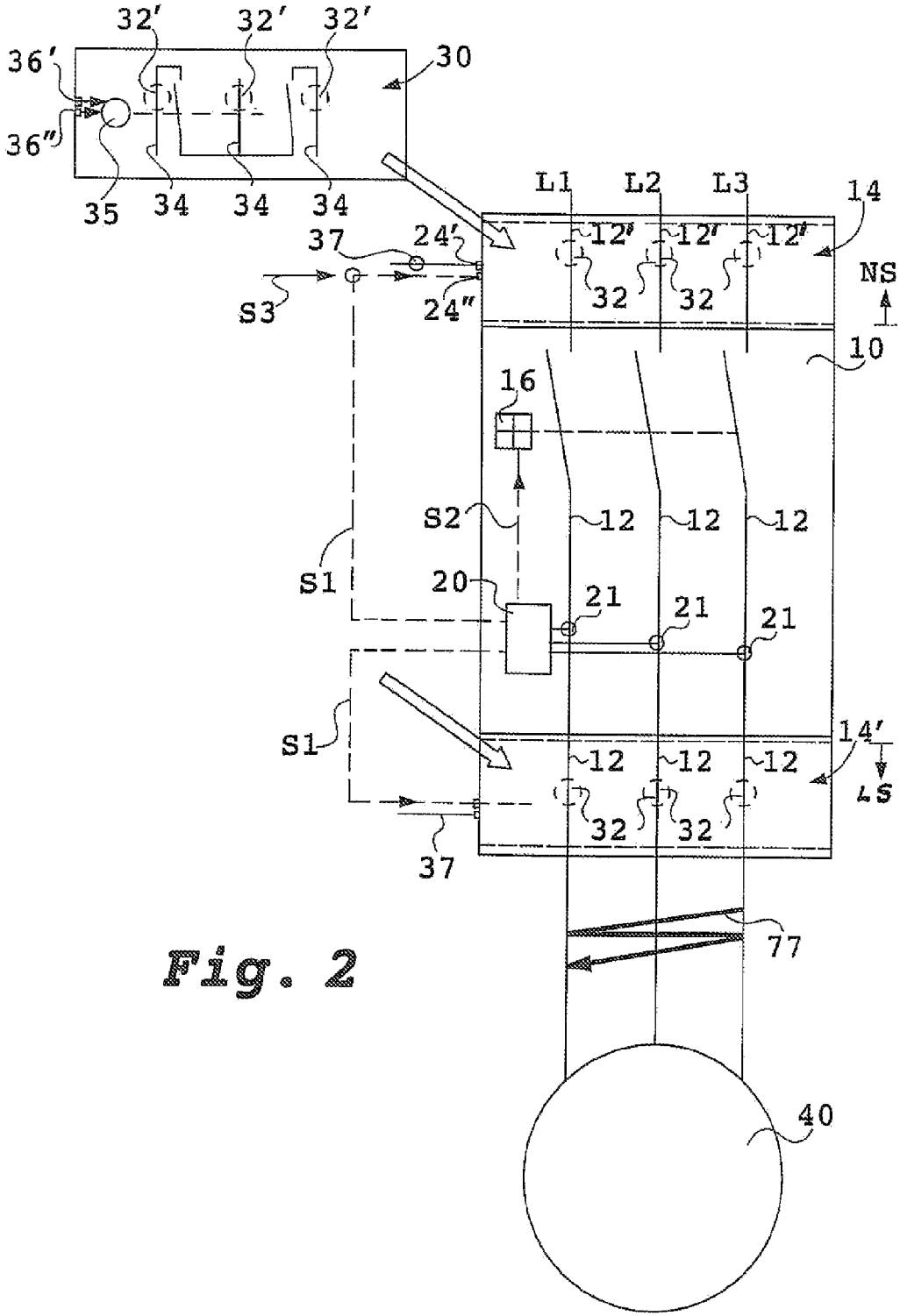
FIG. 2—a schematic circuit diagram of a short circuiter and circuit breaker combination, and FIG. 3—a perspective view according to FIG. 2.

In the arrangement according to FIG. 1, the circuit breaker is supplied from the bottom (on the electrical power system side); in contrast, in FIG. 2, the supply point is (schematically) indicated as being located at the top.

An insertion shaft 14, 14' is present for purposes of attaching the short circuiter. The housing of the circuit breaker—as shown in the figure depiction—is configured with an integrated insertion shaft. The design and the geometry of the short circuiter are such that it is adapted to the housing of the circuit breaker or to the insertion shaft. It is possible to dispense with a separate configuration of the housing of the circuit breaker if an insertion shaft is not felt to be necessary. All that needs to be provided is that the short circuiter 30 can be fastened (flanged) in some manner or other to the connecting bars.

On the front of the circuit breaker, there are setting knobs of the type that can be commonly used in such switches. For example, these knobs can serve to set the short-circuit parameters.

The assembly (insertion and installation) of the short circuiter is indicated in the figures by means of arrows.

Figure 3:
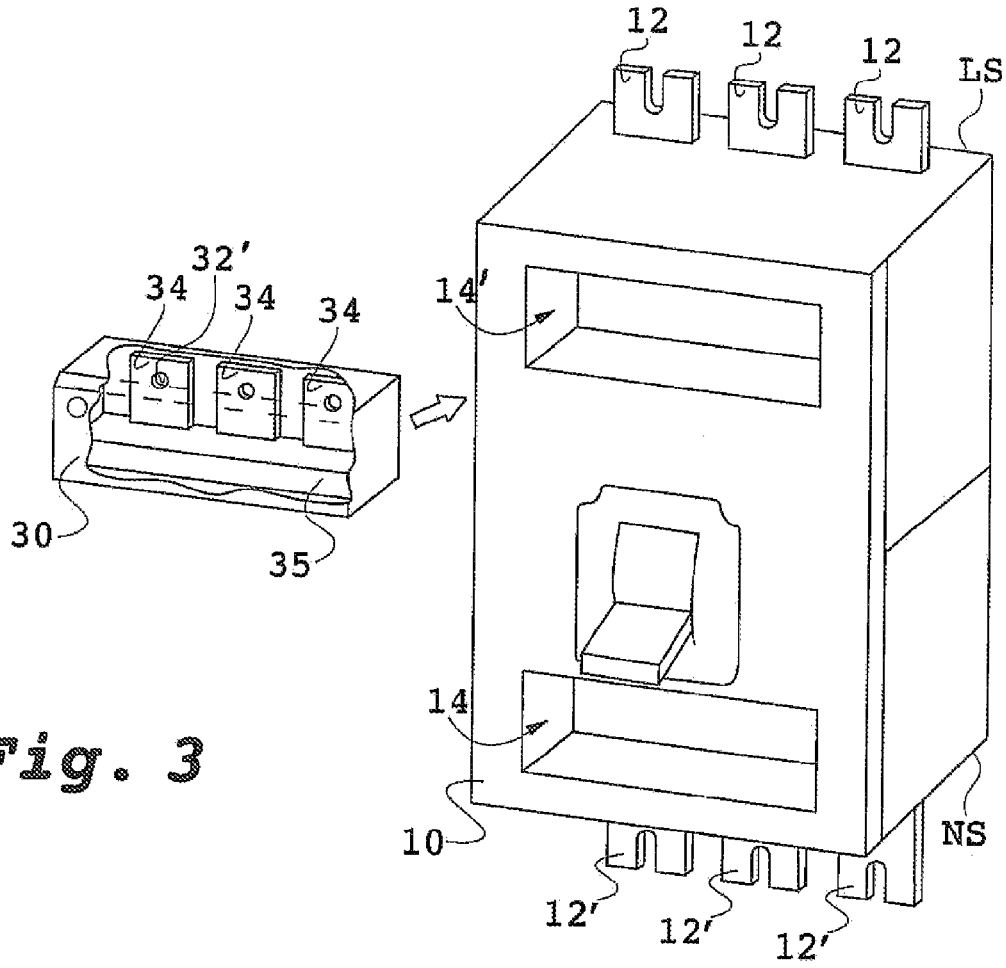

Preferably, the circuit breaker can be configured on the electric power system side NS of the circuit breaker as well as on the load side LS of the circuit breaker for the installation of a short circuiter 30. It should be noted that, in FIGS. 1 and 3, the load side LS is at the top and in FIG. 2 the load side LS is at the bottom.

In FIG. 1A, a pyrotechnical generator in the short circuiter is shown with the reference numeral 35. Connecting plugs and lines for the pyrotechnical gas generator(s) (reference numeral 35) are arranged in a protected manner in the housing part of the short circuiter. The connection plugs are secured against being inadvertently pulled out. The connecting bars 34 of the short circuiter 30, in which the bores 32' are present, are contacted, and thus connected in parallel, with the conductor bars 12 and/or 12' at the fastening sites. The short circuiter 30 is tripped by the occurrence of a fault current, primarily in the case of a short-circuit in the electrical installation 40.

The circuit diagram of the circuit breaker and short circuiter combination is schematically shown in FIG. 2.

A short-circuit is detected by the electronic detection unit 20 of the power breaker (short-circuit actuator), but not by the overload release. The core of the detection unit 20 is a current transformer 21.

The detection unit is set at pre-specified values (threshold) for the rate of current rise and for the current intensity. If a pre-specified threshold is exceeded, for instance, if an arcing fault 77 occurs, the detection unit 20 sends a signal (S1, S2) to the short circuiter 30 as well as to the breaker latch, said signal containing the "command" S2 to open the contacts of the circuit breaker 10.

Now the turn-off time of the circuit breaker begins and, at the end of this time, the short circuiter (and the downstream electrical installation 40) that led to the short-circuit is disconnected from the electrical power system.

The electrical contact means are designated with the reference numerals 24', 24". They are configured to accommodate electrical counter-contact means 36', 36" arranged on the short circuiter. The electrical contact means (for instance, plugs and sockets) are automatically coupled when the short circuiter is installed.

After a switching operation of the short circuiter 30, it is provided that a blocking device that prevents the circuit breaker from being switched back on is made operational. The blocking function can be configured to operate mechanically or electromechanically.

In order to re-start the electrical installation, the short circuiter should be replaced by a new, properly functioning short circuiter. The blocking function is eliminated in this process. The circuit breaker is equipped to switch a short-circuit current multiple times, so that the circuit breaker can continue to be operated if a fault current occurs several times.

A detection unit for arcing faults is not shown in greater detail. Reference to such a detection unit (EP 0575 932 B1) was already made in the introduction. Here, an optical unit with optical waveguides is employed that is coupled to a parallel current detection mechanism (for instance, by means of Hall sensors). When the discharge of the arcing fault occurs and with the fast rise in the fault current caused by the arc, a switching signal S3 is sent by the arcing-fault detector to the short circuiter which is then put into action.

FIG. 3 once again shows a perspective view according to FIG. 2 with a schematically depicted compartment 14' on the load side LS (top) and a compartment 14 on the electrical power system side NS (bottom) for the installation of the short circuiter 35.

What is claimed is:

1. A circuit breaker for multi-phase power comprising:

an opening-closing apparatus configured to open and close each phase of the multiphase power;

a detection unit configured to detect a fault current in at least one phase of an electrical installation being protected by the circuit breaker;

a plurality of connecting bars disposed on a load side of the circuit breaker; and a short circuiter detachably disposed on the connecting bars and configured to perform, based on the fault current detected by the fault-current detection unit, a switching operation so as to produce a short circuit between the connecting bars.

2. The circuit breaker as recited in claim 1, further comprising a plurality of further connecting bars disposed on an electric power system side of the circuit breaker, and a further short circuiter disposed on the further connecting bars.

3. The circuit breaker as recited in claim 1, wherein the fault current is indicative of an arcing fault.

4. The circuit breaker as recited in claim 1, wherein the fault current is indicative of a short circuit.

5. The circuit breaker as recited in claim 1, further comprising a fastening for installing the short circuiter.

6. The circuit breaker as recited in claim 1, further comprising an insertion shaft and wherein the short circuiter is disposed in the insertion shaft.

7. The circuit breaker as recited in claim 6, further comprising an electrical contact element configured to accommodate an electrical counter-contact element disposed on the short circuiter.

8. The circuit breaker as recited in claim 6, wherein the insertion shaft is configured so that it can be locked.

9. The circuit breaker as recited in claim 7, wherein the electrical contact element and the electrical counter-contact element are configured to transmit electric power and operating variables between the circuit breaker and the short circuiter.

10. The circuit breaker as recited in claim 1, further comprising a blocking device, wherein after an actuating of a switching function in the short circuiter, the blocking device prevents the circuit breaker from being switched on again.

11. The circuit breaker as recited in claim 1, wherein the detection unit is an electronic detection unit.

12. The circuit breaker as recited in claim 1, wherein the detection unit is configured to detect an arcing fault.

13. The circuit breaker as recited in claim 1, wherein the circuit breaker is configured for low voltage power.

* * * * *